US005176504A

United States Patent [19]

Moriya et al.

[11] Patent Number: 5,176,504

[45] Date of Patent: Jan. 5, 1993

[54] APPARATUS FOR CONTROLLING HYDRAULIC PUMPS FOR CONSTRUCTION MACHINE

[75] Inventors: Yukio Moriya; Shigeru Kinoshita; Takumi Onoda; Toshio Yokoyama, all of Hirakata, Japan

[73] Assignee: Kabushiki Kaisha Komatsu Seisakusho, Japan

[21] Appl. No.: 820,868

[22] PCT Filed: Jul. 27, 1990

[86] PCT No.: PCT/JP90/00964

§ 371 Date: Jan. 17, 1992

§ 102(e) Date: Jan. 17, 1992

[87] PCT Pub. No.: WO91/02162

PCT Pub. Date: Feb. 21, 1991

[30] Foreign Application Priority Data

Jul. 27, 1989 [JP] Japan ..... 1-195276

[51] Int. Cl.[5] ..... F04B 1/28

[52] U.S. Cl. ..... 417/216; 60/428

[58] Field of Search ..... 417/216; 60/421, 428, 60/430

[56] References Cited

U.S. PATENT DOCUMENTS

| | | | |
|---|---|---|---|
| 4,395,199 | 7/1983 | Izumi et al. | 60/449 X |
| 4,773,369 | 9/1988 | Kobayashi | 417/216 X |
| 4,809,504 | 3/1989 | Izumi et al. | 417/216 X |
| 5,048,293 | 9/1991 | Aoyagi | 60/428 X |

FOREIGN PATENT DOCUMENTS

| | | | |
|---|---|---|---|
| 61-200344 | 9/1986 | Japan . | |
| 62-8619 | 2/1987 | Japan . | |
| 63-309789 | 12/1988 | Japan | 417/216 |

*Primary Examiner*—Leonard E. Smith
*Attorney, Agent, or Firm*—Welsh & Katz

[57] ABSTRACT

An apparatus for controlling hydraulic pumps for a construction machine wherein the construction machine includes first and second hydraulic pumps adapted to be driven by an engine and hydraulic actuators hydraulically connected to the first and second hydraulic pumps via first and second actuating valves is disclosed. A controlling section calculates extra horse powers $\Delta HP_1$ and $\Delta HP_2$ based on reference allowable absorptive horse powers set relative to the first and second hydraulic pumps and actual absorptive horse powers ($HP_{01}$) and ($HP_{02}$) derived from the first and second hydraulic pumps. In addition, the controlling section calculates allowable discharge capacities ($V_{1P}$) and ($V_{2P}$) based on the number (N) of revolutions of the engines, pressures ($P_1$) and ($P_2$) of hydraulic oils discharged from the first and second hydraulic pumps, the extra horse powers $\Delta HP_1$ and $\Delta HP_2$ and allowable discharge capacities ($V_{1P}$) and ($V_{2P}$). Then, the controlling section selects a smaller one of a target discharge capacity and the allowable discharge capacity ($V_{1P}$) and a smaller one of another target discharge capacity and the allowable discharge capacity ($V_{2P}$) as minimum target discharge capacities ($V_1$) and ($V_2$). Thereafter, the controlling section controls swash plate angles of the first and second hydraulic pumps such that the minimum target discharge capacities ($V_1$) and ($V_2$) are correctly set corresponding to the first and second hydraulic pumps. Consequently, absorptive horse powers to be derived from the first and second hydraulic pumps can properly be controlled while a sum of the reference allowable absorptive horse powers is kept constant.

6 Claims, 3 Drawing Sheets

APPARATUS FOR CONTROLLING HYDRAULIC PUMPS FOR CONSTRUCTION MACHINE

TECHNICAL FIELD

The present invention relates to an apparatus for controlling hydraulic pumps which are mounted on a construction machine.

BACKGROUND ART

For example, a construction machine for performing excavating operations is generally equipped with two variable capacity type hydraulic pumps adapted to be driven by an engine in order to feed a pressurized hydraulic oil to hydraulic actuators in the form of hydraulic cylinders, hydraulic motors or the like.

A technology for varying horse powers to be absorbed by variable capacity type hydraulic pumps corresponding to a magnitude of load while maintaining a sum of the absorptive horse powers of the hydraulic pumps at a level corresponding to a predetermined value has been heretofore proposed (e.g., refer to Japanese Patent Application NO. 60841/1984).

The foregoing predetermined value is practically set to a value which represents a rated horse power derived from the engine.

With the prior technology as described above, in a case where one of the hydraulic pumps has a smaller absorptive horse power, the absorptive horse power allowable relative to the other hydraulic pump is enhanced correspondingly. This enables the rated horse power of the engine to be utilized effectively.

However, it has been found that the prior technology has the following drawback.

Specifically, since the absorptive horse powers of the respective hydraulic pumps are not individually monitored, optimum distribution of the absorptive horse powers relative to the respective hydraulic pumps sometimes fails to be carried out.

Another drawback of the prior technology is that a controlling operation is performed with a low accuracy, because the prior technology is practiced by employing mechanical components.

The present invention has been made with the foregoing background in mind and its object resides in providing an apparatus for controlling hydraulic pumps for a construction machine wherein distribution of horse powers to be absorbed by the hydraulic pumps can adequately be carried out with an excellent accuracy.

DISCLOSURE OF THE INVENTION

To accomplish the above object, the present invention provides an apparatus for controlling hydraulic pumps for a construction machine wherein the construction machine includes first and second hydraulic pumps adapted to be driven by an engine and hydraulic actuators hydraulically connected to the first and second hydraulic pumps via first and second actuating valves, wherein the apparatus includes as essential components engine revolution number detecting means for detecting the number (N) of revolutions of the engine, pressure detecting means for detecting pressures ($P_1$) and ($P_2$) of hydraulic oils discharged from the first and second hydraulic pumps, horse power setting means for presetting reference absorptive horse powers relative to the first and second hydraulic pumps, target discharge capacity commanding means for commanding target discharge quantities ($V_{1L}$) and ($V_{2L}$) corresponding to quantities of actuations of the first and second actuating valves, absorptive horse power calculating means for calculating actual absorptive horse powers ($HP_{01}$) and ($HP_{02}$) derived from the first and second hydraulic pumps, extra horse power calculating means for calculating extra horse powers ($\Delta HP_1$) and ($\Delta HP_2$) based on the reference allowable absorptive horse powers and the actual absorptive horse powers ($\Delta HP_1$) and ($\Delta HP_2$), the extra horse powers ($\Delta HP_1$) and ($\Delta HP_2$) failing to be absorbed by the first and second hydraulic pumps, means for calculating allowable discharge capacities ($V_{1P}$) and ($V_{2P}$) based on the engine revolution number (N), the discharge pressures ($P_1$) and ($P_2$), the extra horse powers ($\Delta HP_1$) and ($\Delta HP_2$) and the reference allowable horse powers relative to the first and second hydraulic pumps, means for selecting a smaller one of the target discharge capacity ($V_{1L}$) and the allowable discharge capacity ($V_{1P}$) and a smaller one of the target discharge capacity ($V_{2L}$) and the allowable discharge capacity ($V_{2P}$) as minimum target discharge capacities ($V_1$) and ($V_2$), and swash plate controlling means for controlling swash plate angles of the first and second hydraulic pumps such that the capacities of hydraulic oils discharged from the first and second hydraulic pumps coincide with the minimum target discharge capacities ($V_1$) and ($V_2$)

According to the present invention, a controlling section individually monitors the actual absorptive horse powers relative to the first and second hydraulic pumps, whereby distribution of horse powers to be absorbed by the respective hydraulic pumps can be carried out adequately. In addition, since no mechanical component is used for constituting the apparatus of the present invention, the controlling section can perform a controlling operation with an excellent accuracy.

BEST MODE FOR CARRYING OUT THE INVENTION

Now, the present invention will be described in detail hereinafter with reference to the accompanying drawings which illustrate a preferred embodiment of the present invention.

Figure 1:
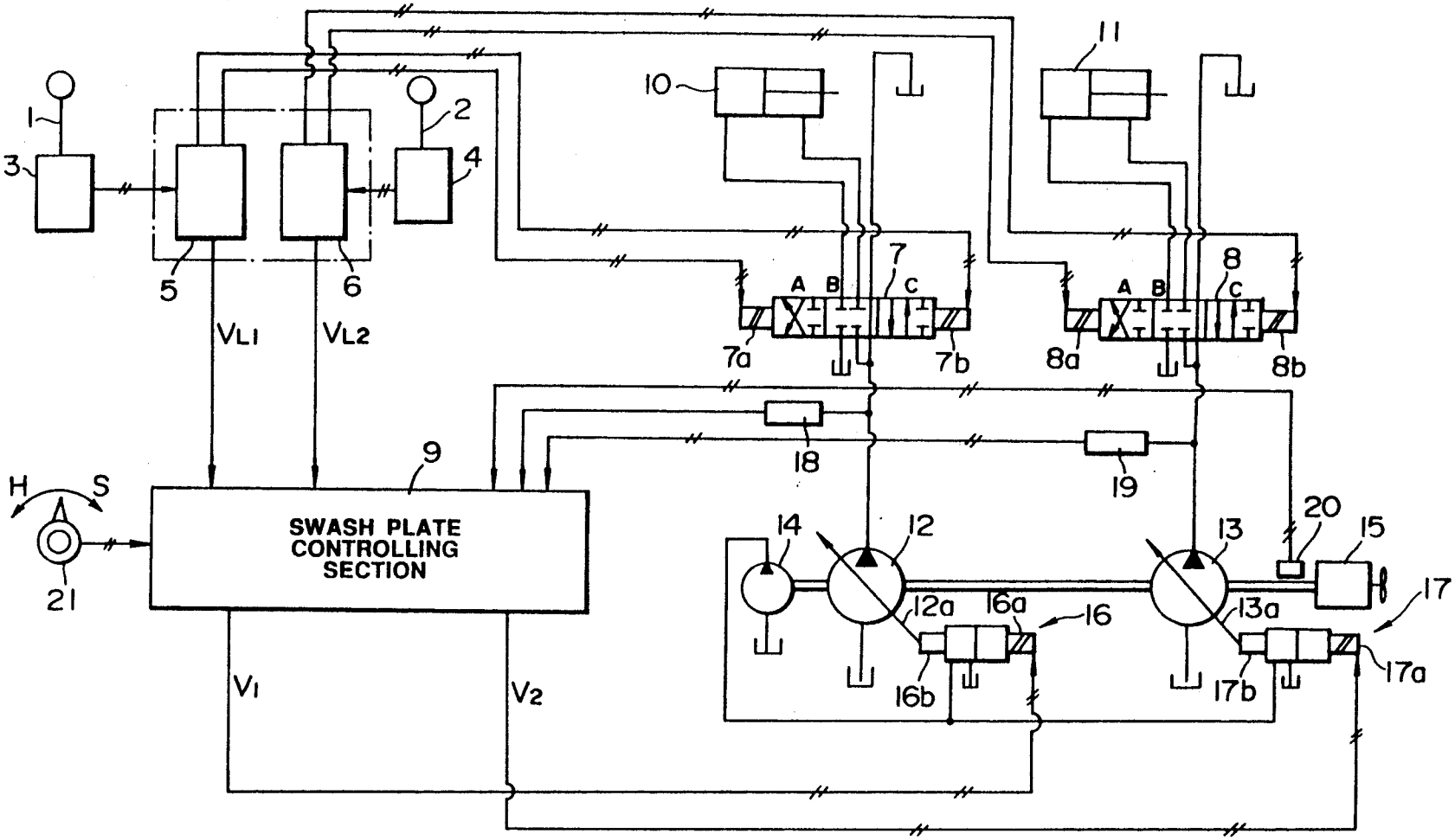
FIG. 1 is an illustrative view which schematically shows the structure of an apparatus for controlling hydraulic pumps for a construction machine in accordance with an embodiment of the present invention.

FIG. 1 is an illustrative view which schematically shows the structure of an apparatus for controlling hydraulic pumps for a construction machine in accordance with the embodiment of the present invention.

Referring to FIG. 1, actuating levers 1 and 2 are electrically connected to actuation quantity detectors 3 and 4 each composed of a potentiometer or the like instrument. A series of signals each having a magnitude and a polarity corresponding to a quantity of actuation of the actuating lever 1 and a direction of steering induced by the actuating lever 1 are outputted from the actuation quantity detector 3, while a series of signals each having a magnitude and a polarity corresponding to a quantity of actuation of the actuating lever 2 and a direction of steering induced by the actuating lever 2 are outputted from the actuation quantity detector 4.

These output signals from the actuation quantity detectors 1 and 2 are sequentially fed to command signal forming sections 5 and 6.

The command signal forming sections 5 and 6 serve to output valve controlling signals corresponding to magnitudes of output signals and polarities of the same from the actuation quantity detectors 3 and 4. The valve controlling signal outputted from the command signal forming section 5 is fed to solenoids 7*a* and 7*b* of an actuating valve 7, while the valve controlling signal outputted from the command signal forming section 6 is fed to solenoids 8*a* and 8*b* of an actuating valve 8.

In addition, the command signal forming sections 5 and 6 output signals for commanding target discharge capacities $V_{L1}$ and $V_{L2}$ corresponding to the output signals from the actuation quantity detectors 3 and 4, and these command signals are fed to a swash plate controlling section 9 to be described later.

Hydraulic cylinders 10 and 11 each serving as a hydraulic actuator are hydraulically connected to variable capacity type hydraulic pumps 12 and 13 via the actuating valves 7 and 8.

With such construction, in a case where the actuating valve 7 is brought in the state A or the state C as shown in FIG. 1 in response to the valve controlling signal, the hydraulic cylinder 10 performs an expanding operation or a retracting operation with the pressurized hydraulic oil which is discharged from the hydraulic cylinder 10.

Also with respect to the other actuating valve 8, same operations as those of the actuating valve 7 are performed with the hydraulic cylinder 11.

According to the embodiment of the present invention, the hydraulic cylinders 10 and 11 serve as a boom cylinder and an arm cylinder for a hydraulic type excavator.

The variable capacity type hydraulic pumps 12 and 13 and a control pump 14 are driven by an engine 15.

The hydraulic pumps 12 and 13 are provided with swash plates 12*a* and 13*a* of which inclination angle is varied by actuating servo-actuators 16 and 17 for turnably driving the swash plates 12*a* and 13*a*. A discharge flow rate (cc/rev) per a single revolution of each of the hydraulic pumps 12 and 13 increases more and more as an inclination angle of each of the swash plates 12*a* and 13*a* is enlarged.

Incidentally, the inclination angle is hereinafter referred to as a swash plate angle.

The servo-actuator 16 is composed of a servo-valve 16*a* for controlling a flow rate of pressurized hydraulic oil to be discharged from the control pump 14, a cylinder 16*b* adapted to be actuated by the pressurized hydraulic oil controlled by the servo-valve 16*a* and other associated components so as to allow the swash plate angle of the hydraulic pump 12 to be set to a magnitude corresponding to the command signal which has been inputted into the servo-valve 16*a*.

It should be added that the servo-actuator 17 is composed of a servo-valve 17*a*, a cylinder 17*b* and other associated components and functions in the same manner as the servo-actuator 16.

Pressure detectors 18 and 19 are hydraulically connected to hydraulic passages of the hydraulic pumps 12 and 13 on the discharge side, and a rotation sensor 20 for detecting the engine speed of the engine 15 is arranged at the position in the vicinity of an output shaft 15*a* of the engine 15.

Output signals from the pressure sensors 18 and 19 and the rotation sensor 20 are fed to the swash plate controlling section 9, respectively.

Now, it is assumed that absorptive horse powers derived from the hydraulic pumps 12 and 13 are designated by $HP_1$ and $HP_2$. The absorptive horse powers $HP_1$ and $HP_2$ are represented by the following equations.

$$HP_1 = K_1 \cdot N \cdot V_1 \cdot P_1 = K_1 \cdot Q_1 \cdot P_1 \quad (1)$$

$$HP_2 = K_2 \cdot N \cdot V_2 \cdot P_2 = K_2 \cdot Q_2 \cdot P_2 \quad (2)$$

where $K_1$ and $K_2$:constant

N:the number of revolutions of the engine 15

$V_1$:capacity of hydraulic oil discharged from the hydraulic pump 12 (cc/rev)

$V_2$:capacity of hydraulic oil discharged from the hydraulic pump 13 (cc/rev)

$P_1$:pressure of hydraulic oil discharged from the hydraulic pump 12 (kg/cm$^2$)

$P_2$:pressure of hydraulic oil discharged from the hydraulic pump 13 (kg/cm$^2$)

$Q_1$:quantity of hydraulic oil discharged from the hydraulic pump 12 (cc/min)

$Q_2$:quantity of hydraulic oil discharged from the hydraulic pump 13 (cc/min)

Figure 3:
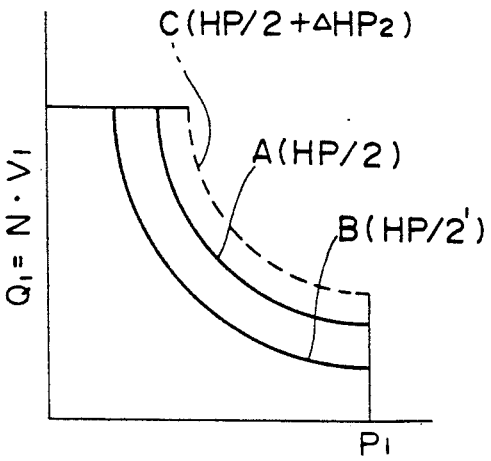
FIG. 3 and FIG. 4 are a graph which shows by way of example the relationship between a pressure of hydraulic oil discharged from a certain hydraulic pump and a capacity of hydraulic oil discharged from the hydraulic pump so as to allow the hydraulic pump to be driven with a predetermined absorptive horse power, respectively.

In a case where the absorptive horse power $HP_1$ derived from the hydraulic pump 12 is to be maintained at a level of a half of the rated horse power HP derived from the engine 15 as well as preset horse power HP/2' lower than HP/2, it suffices that the capacity $V_1$ of hydraulic oil discharged from the hydraulic pump 12 is controlled such that the quantity $Q_1$ of hydraulic oil discharged from the hydraulic pump 12 and the pressure $P_1$ of hydraulic oil discharged from the hydraulic pump 12 are determined in accordance with the relationship as represented by hyperbolic curves A and B in FIG. 3.

Figure 4:
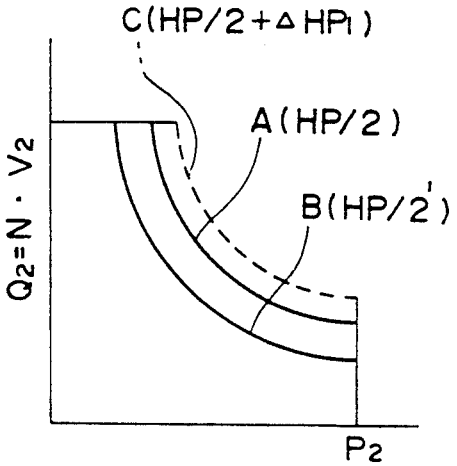

Similarly, in a case where the absorptive horse power $HP_2$ derived from the hydraulic pump 13 is to be maintained at a level of HP/2 as well as a level of HP/2' lower than HP/2, it suffices that the capacity $V_2$ of hydraulic oil discharged from the hydraulic pump 13 is controlled such that the quantity $Q_2$ of hydraulic oil discharged from the hydraulic pump 13 and the pressure $P_2$ of hydraulic oil discharged from the hydraulic pump 13 are determined in accordance with the relationship as represented by hyperbolic lines A and B in FIG. 4.

HP/2 and HP/2' as noted above are hereinafter referred to as a reference absorptive horse power, respectively.

It should be noted that the rated horse power HP refers to a maximum horse power which can be taken from the engine 14 in the fully throttled state.

Figure 2:
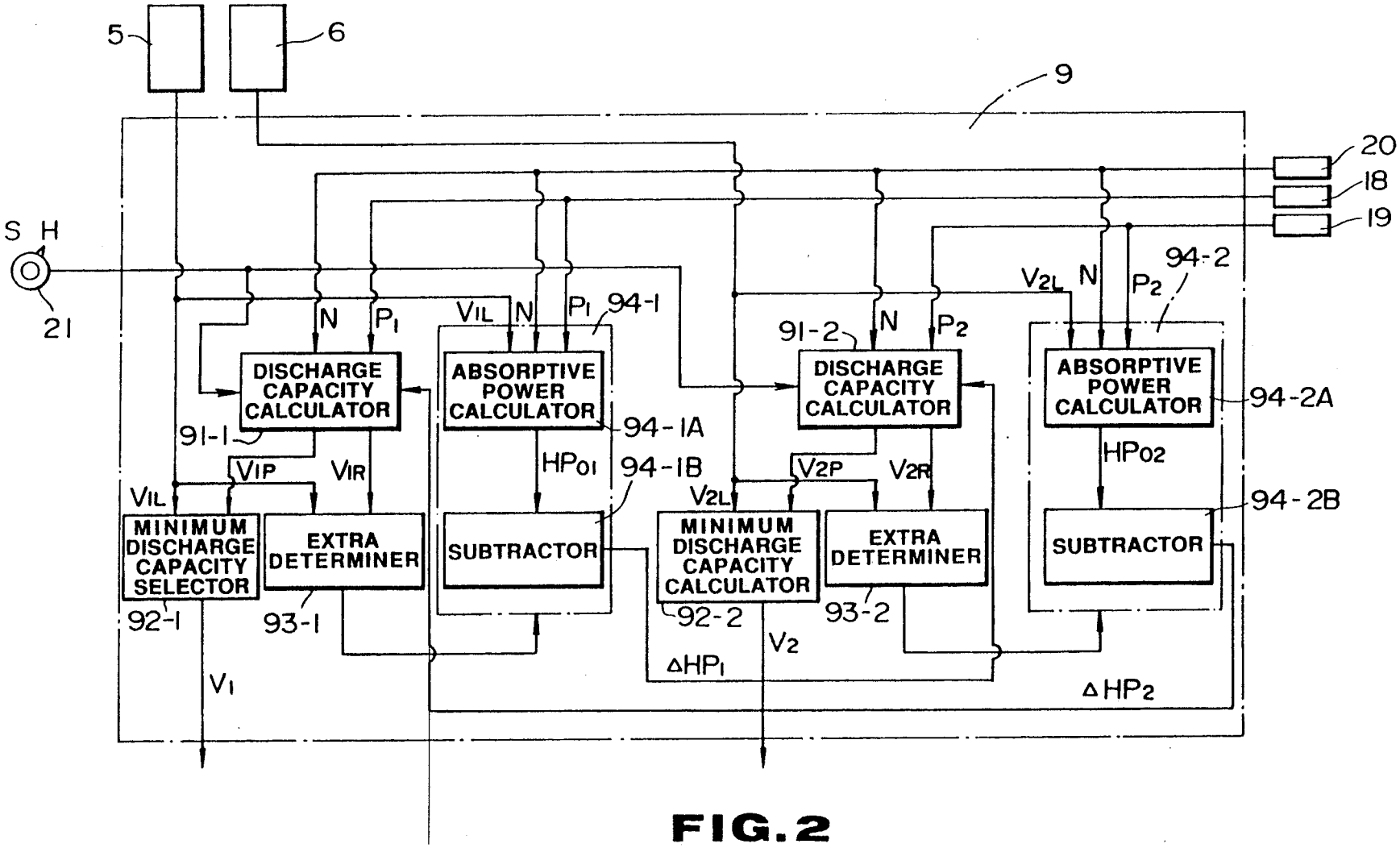
FIG. 2 is a block diagram which schematically shows by way of example the structure of a swash plate controlling section.

FIG. 2 is a block diagram which schematically illustrates by way of example the structure of the controlling section 9.

As shown in the drawing, the controlling section 9 includes a discharge capacity calculating portion 91-1 to which an output signal from the pressure sensor 18, an output signal from the rotation sensor 20, a set signal from a operation mode setter 21 and a signal indicative of an extra horse power $\Delta HP_2$ to be described later are fed. In addition, the controlling section 9 includes a discharge capacity calculating portion 91-2 to which an output signal from the pressure sensor 19, an output signal from the rotation sensor 20, a set signal from an operation mode setter 21 and a signal indicative of an extra horse power $\Delta HP_1$ to be described later are fed.

The operational mode setter 21 is a manual actuating switch adapted to selectively indicate a heavy operation mode H and a light operation mode S. When the heavy operation mode H is selectively set, a signal indicative of the reference absorptive horse power HP/2 is outputted from the operation mode setter 21. On the contrary, when the light operation mode S is selectively set, a signal indicative of the reference absorptive horse power HP/2' is outputted from the operation mode setter 21.

When the heavy operation mode H is selectively set, the discharge capacity calculating portion 91-1 calculates an allowable target discharge capacity $V_{1P}$ for allowing the absorptive horse power derived from the hydraulic pump 12 to be raised up to a level of $(HP/2)+\Delta HP_2$ in accordance with the following equation (3).

Additionally, when the light operation mode S is selectively set, the discharge capacity calculating portion 91-1 executes a calculation for replacing HP/2 in the equation (3) with HP/2' and then obtains the allowable target discharge volume $V_{1P}$ for allowing the absorptive horse power derived from the hydraulic pump 12 to be raised up to a level of $(HP/2')+\Delta HP_2$.

Further, even in a case where the operation mode is set to either of H and S, the discharge capacity calculating portion 91-1 calculates a reference target discharge capacity $V_{1R}$ for allowing the absorptive horse power derived from the hydraulic pump 12 to be set to the reference absorptive horse power HP/2 in accordance with the following equation (4).

$$V_{1P}=\{(HP/2)+\Delta HP_2\}/K_1\cdot N\cdot P_1 \quad (3)$$

$$V_{1R}=(HP/2)/K_1\cdot N\cdot P_1 \quad (4)$$

On the other hand, the discharge capacity calculating portion 91-2 executes a calculation in accordance with the following equation (5) and a calculation for replacing HP/2 in the equation (5) with HP/2' and then obtains an allowable target discharge capacity $V_{2P}$ corresponding to the allowable target discharge capacity $V_{1P}$, when the heavy operation mode H is selectively set. Further, the discharge capacity calculating portion 91-2 executes a calculation in accordance with the equation (6) and then obtains a reference target discharge capacity $V_{2R}$ corresponding to the allowable target discharge capacity $V_{1R}$, when the light operation mode S is selectively set.

$$V_{2P}=\{(HP/2)+\Delta HP_1\}/K_2\cdot N\cdot P_2 \quad (5)$$

$$V_{2R}=(HP/2)/K_2\cdot N\cdot P_2 \quad (6)$$

The controlling section 9 further includes a minimum discharge capacity selecting portion 92-1 which compares a signal indicative of a target discharge capacity $V_{1L}$ outputted from the command signal forming section 5 with a signal indicative of the allowable target discharge capacity $V_{1P}$ which has been calculated in the discharge capacity calculating portion 91-1 and then selects and outputs a smaller signal of the foregoing two signals therefrom. Thereafter, the output signal from the minimum discharge capacity selecting portion 92-1 is fed to the servo-actuator 16 shown in FIG. 1 as a swash plate angle commanding signal for allowing the capacity $V_1$ of hydraulic oil discharged from the hydraulic pump 12 to be changed to the target discharge capacity $V_{1L}$ or $V_{1P}$.

The controlling section further includes a minimum discharge capacity selecting portion 92-2 which likewise compares a signal indicative of a target discharge volume $V_{2L}$ outputted from the command signal forming portion 6 with a signal indicative of the allowable target discharge capacity $V_{2P}$ which has been calculated in the discharge capacity calculating portion 91-2 and then selects and outputs a smaller signal of the foregoing two signals. Thereafter, the output signal from the minimum discharge capacity selecting portion 92-2 is fed to the servo-actuator 17 shown in FIG. 1 as a swash plate commanding signal for allowing the capacity $V_2$ of hydraulic oil discharged from the hydraulic pump 13 to be changed to $V_{2L}$ or $V_{2P}$.

The controlling section 9 further includes an extra determining portion 93-1 which compares a signal indicative of the target discharge capacity $V_{1L}$ with a signal indicative of the reference target discharge capacity $V_{1R}$ which has been calculated in the discharge capacity calculating portion 91-1. When it has been found from the result derived from the foregoing comparison that the target discharge capacity $V_{1L}$ is smaller than the reference target discharge capacity $V_{1R}$, the extra determining portion 93-1 outputs an extra indicating signal.

Now, it is assumed that the hydraulic pump 12 discharges pressurized hydraulic oil with the reference target discharge capacity $V_{1R}$. As is apparent from the equation (4), the absorptive horse power derived from the hydraulic pump 12 coincides with the reference absorptive horse power HP/2. In other words, the hydraulic pump 12 is driven in such an operative state that it absorbs all the output horse power HP/2 of the engine 15 in the divided state, i.e., in the operative state which satisfactorily meets the equi-horse power line A shown in FIG. 3.

Therefore, the fact that the relationship between the target discharge capacity $V_{1L}$ and the reference target discharge capacity $V_{1R}$ is such that the former is smaller than the latter represents that the absorptive horse power derived from the hydraulic pump 12 becomes smaller than the reference absorptive horse power HP/2 when the capacity of hydraulic oil discharged from the hydraulic pump 12 is set to the target discharge capacity $V_{1L}$, i.e., that a part of the output horse power HP/2 of the engine 15 in the divided state is not practically used.

In such a case as mentioned above, the extra determining portion 93-1 outputs a signal indicative of the presence of an extra of the engine output to an extra horse power calculating portion 94-1.

The extra horse power calculating portion 94-1 includes an absorptive horse power calculator 94-1A and a subtracter 94-1B. When the extra indicating signal is inputted into the extra horse power calculating portion 94-1, the absorptive horse power calculator 94-1A calculates the extra horse power $\Delta HP_1$ shown in the equation (5) in response to the extra indicating signal transmitted from the extra determining section 93-1.

Specifically, the absorptive horse power calculator 94-1A calculates an actual absorptive horse power $HP_{01}$ at the time of the target discharge capacity $V_{1L}$ with reference to the target discharge capacity $V_{1L}$, the engine revolution number N and the pressure $P_1$ of hydraulic oil discharged from the hydraulic pump 12.

It should be noted that the absorptive horse power calculator 94-1A executes the foregoing calculation while the target discharge capacity $V_{1L}$ is substituted for the capacity $V_1$ of hydraulic oil discharged from the hydraulic pump 12 shown in the equation (1).

On the other hand, the subtracter 33-1B executes a calculation for subtracting the actual absorptive horse power $HP_{01}$ from the reference absorptive horse power HP/2 and then obtains the extra horse power $\Delta HP_1$ based on the results derived from this calculation.

The signal indicative of the extra horse power $\Delta HP_1$ outputted from the extra horse power calculating portion 94-1 is fed to the discharge capacity calculating portion 91-2 which is arranged for the hydraulic pump 13.

An extra determining portion 93-2 and an extra horse power calculating portion 94-2 are substantially same to the extra horse power determining portion 93-1 and the extra horse calculating portion 94-1 in structure and function. Therefore, repeated description will not be required. It should be added that an output signal indicative of the extra power force $\Delta HP_2$ outputted from the extra horse power calculating portion 94-2 is fed to the discharge capacity calculating portion 91-1 which is arranged for the hydraulic pump 12.

According to the embodiment of the present invention, in a case where a signal indicative of the target discharge capacity $V_{1P}$ is outputted from the minimum discharge capacity selecting portion 92-1 and a signal indicative of the extra horse power $\Delta HP_2$ is fed to the discharge capacity calculating portion 91-1, the hydraulic pump 12 absorbs a horse power corresponding to a line C shown in FIG. 3. Incidentally, in a case where the position along the line C varies corresponding to variation of the extra horse power $\Delta HP_2$ and the extra horse power $\Delta HP_2$ is reduced to a level of zero, the line C overlaps the line A. In this case, the absorptive force power derived from the hydraulic pump 12 is changed to HP/2 and the absorptive horse power derived from the other hydraulic pump 13 is likewise changed to HP/2.

On the other hand, in a case where a signal indicative of the target discharge capacity $V_{1L}$ is outputted from the minimum discharge capacity selecting portion 92-1, the absorptive horse power derived from the hydraulic pump 12 is reduced lower than HP/2 or $(HP/2)+\Delta HP_1$. When it has been found that the absorptive horse power derived from the hydraulic pump 12 is reduced lower than HP/2, a signal indicative of the extra horse power $\Delta HP_1$ is fed to the discharge capacity calculating portion 91-2.

As is apparent from the above description, according to the embodiment of the present invention, the swash plate angle of each of the hydraulic pumps 12 and 13, i.e., the discharge capacity of each of the hydraulic pumps 12 and 13 is controlled such that a sum of the absorptive horse power derived from the hydraulic pump 12 and the absorptive horse power derived from the hydraulic pump 13 is normally smaller than the rated horse power of the engine 15. In a case where one of the hydraulic pumps 12 and 13 receives a small magnitude of load, the allowable absorptive horse power derived from the other hydraulic pump can automatically be enlarged by a quantity corresponding to the extra horse power, whereby the rated horse power of the engine 15 can be utilized effectively.

Figure 5:
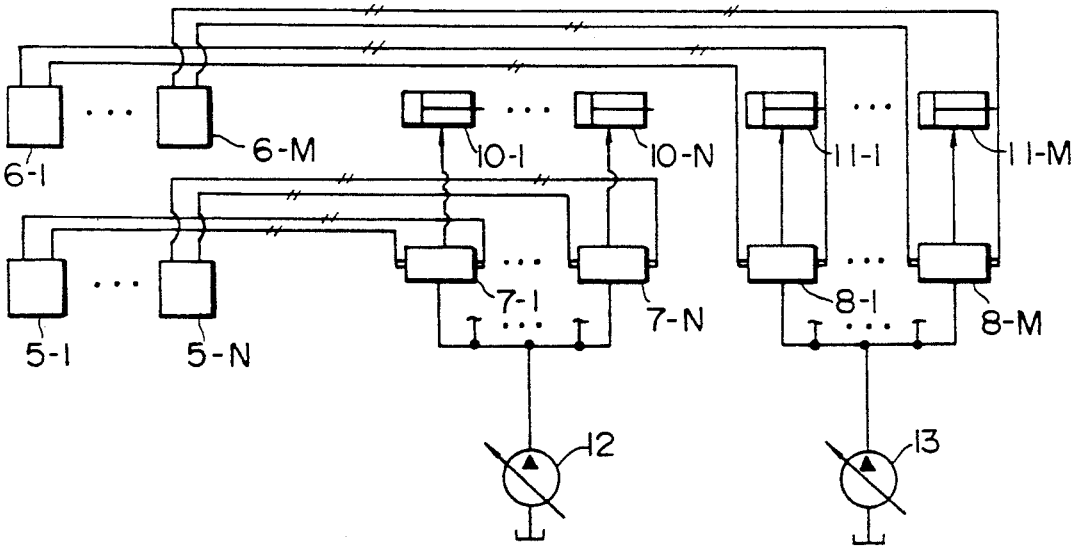
FIG. 5 is an illustrative view which schematically shows a case where a plurality of hydraulic actuators are hydraulically connected to a single hydraulic pump.

According to the embodiment of the present invention, the hydraulic actuators 10 and 11 are arranged corresponding to the hydraulic pumps 12 and 13. Alternatively, a plurality of hydraulic actuators 10-1 to 10-N and 11-1 to 11-M may be arranged corresponding to the hydraulic pumps 12 and 13, as shown in FIG. 5. In this case, as is apparent from the drawing, a plurality of actuating valves 7-1 to 7-N and 8-1 to 8-M are arranged corresponding to the hydraulic actuators 10-1 to 10-N and 11-1 to 11M and moreover a plurality of command signal forming sections 5-1 to 5-N and 6-1 to 6-M are arranged corresponding to the actuating valves 7-1 to 7-N and 8-1 to 8-M.

In this case, a signal resulting from totalization of output signals from the respective signal forming sections 5-1 to 5-N is used as a signal representative of the target discharge capacity $V_{1L}$ shown in FIG. 2, while a signal resulting from totalization of output signals from the respective signal forming sections 6-1 to 6-M is used as a signal representative of the target discharge capacity $V_{2L}$ in the drawing.

Further, according to the embodiment of the present invention, a half of the rated horse power HP of the engine 15 is equally distributed to each of the hydraulic pumps 12 and 13 as an allowable absorptive horse power. For example, in a case where it is previously informed on the basis of a given specification for the construction machine that a load to be born by the hydraulic pump 12 is smaller than a load to be born by the hydraulic pump 13, a rate of the allowable absorptive horse power to be distributed to the hydraulic pump 12 may be set higher than a rate of the allowable absorptive horse power to be distributed to the hydraulic pump 13.

INDUSTRIAL APPLICABILITY

As is readily apparent from the above description, the apparatus for controlling hydraulic pumps for a construction machine in accordance with the present invention is advantageously employable for properly controlling the absorptive horse power derived from each hydraulic pump. Especially, the apparatus is preferably employable for a construction machine for performing an excavating operation wherein a load to be born by each hydraulic pump varies largely.

I claim:

1. An apparatus for controlling hydraulic pumps for a construction machines wherein said construction machine includes first and second hydraulic pumps adapted to be driven by an engine and hydraulic actuators hydraulically connected to said first and second hydraulic pumps via first and second actuating valves, wherein said apparatus comprises;

engine revolution number detecting means for detecting the number (N) of revolutions of said engine, pressure detecting means for detecting pressures ($P_1$) and ($P_2$) of hydraulic oils discharged from said first and second hydraulic pumps, horse power setting means for presetting reference allowable absorptive horse powers relative to said first and second hydraulic pumps, target discharge capacity commanding means for commanding target discharge quantities ($V_{1L}$) and ($V_{2L}$) corresponding to quantities of actuations of said first and second actuating valves, absorptive horse power calculating means for calculating actual absorptive horse powers ($HP_{01}$) and ($HP_{02}$) derived from said first and second hydraulic pumps, extra horse power calculating means for calculating extra horse powers ($\Delta HP_1$) and ($\Delta HP_2$) based on said reference allowable absorptive horse powers and said actual absorptive horse powers ($HP_{01}$) and ($HP_{02}$), said extra horse powers ($\Delta HP_1$) and ($\Delta HP_2$) failing to be absorbed by said first and second hydraulic pumps, means for calculating allowable discharge capacities ($V_{1P}$) and ($V_{2P}$) based on said engine revolution number (N), said discharge pressure ($P_1$) and ($P_2$), said extra horse powers ($\Delta HP_1$) and ($\Delta HP_2$) and said reference allowable horse powers relative to said first and second hydraulic pumps, means for selecting a smaller one of said target discharge capacity ($V_{1L}$) and said allowable discharge capacity ($V_{1P}$) and a smaller one of said target discharge capacity ($V_{2L}$) and said allowable discharge capacity ($V_{2P}$) as minimum target discharge capacities ($V_1$) and ($V_2$), and swash plate controlling means for controlling swash plate angles of said first and second hydraulic pumps such that the capacities of hydraulic oils discharged from said first and second hydraulic pumps coincide with said minimum target discharge capacities ($V_1$) and ($V_2$).

2. An apparatus for controlling hydraulic pumps for a construction machine as claimed in claim 1, wherein said horse power setting means serves to allow said reference allowable absorptive horse powers relative to said first and second hydraulic pumps to be set to a half of the rated horse power of the engine, respectively.

3. An apparatus for controlling hydraulic pumps for a construction machine as claimed in claim 1, wherein said horse power setting means includes a function of varying said reference allowable absorptive horse powers.

4. An apparatus for controlling hydraulic pumps for a construction machine as claimed in claim 1, wherein said horse power calculating means calculates said actual absorptive horse powers ($HP_{01}$) and ($HP_{02}$) based on said engine revolution the number (N), said discharge pressures ($P_1$) and ($P_2$) and said target discharge capacities ($V_{1L}$) and ($V_{2L}$).

5. An apparatus for controlling hydraulic pumps for a construction machine as claimed in claim 1, wherein in a case where a plurality of first actuating valves and a plurality of second actuating valves are arranged corresponding to said first and second hydraulic pumps, said target discharge capacities ($V_{1L}$) and ($V_{2L}$) are set based on a sum of quantities of actuations of said first plural actuating valves and a sum of quantities of actuations of said second plural actuating valves.

6. An apparatus for controlling hydraulic pumps for a construction machine as claimed in claim 1, wherein said reference allowable absorptive horse powers relative to said first and second pumps differ from each other.

* * * * *